United States Patent [19]

Allart et al.

[11] 4,335,013

[45] Jun. 15, 1982

[54] SOLVENTS USEFUL IN PRESSURE-SENSITIVE MARK-RECORDING SYSTEMS

[75] Inventors: Pierre J. Allart, Brussels; Claude A. Guillaume, Jodoigne, both of Belgium

[73] Assignee: Monsanto Company, St. Louis, Mo.

[21] Appl. No.: 179,414

[22] Filed: Aug. 18, 1980

[30] Foreign Application Priority Data

Aug. 24, 1979 [GB] United Kingdom ..... 7929565

[51] Int. Cl.[3] ..... B01F 1/00

[52] U.S. Cl. ..... 252/364; 106/21; 252/316; 282/27.5; 428/914; 428/320.6

[58] Field of Search ..... 252/316, 364

[56] References Cited

U.S. PATENT DOCUMENTS

| | | | |
|---|---|---|---|
| 3,836,383 | 9/1974 | Kiritani et al. | 252/316 X |
| 3,979,327 | 9/1976 | Herber | 252/316 X |
| 4,070,303 | 1/1978 | Ohkubo et al. | 252/316 X |
| 4,191,403 | 3/1980 | Dessauer et al. | 252/316 X |

*Primary Examiner*—Richard D. Lovering

*Attorney, Agent, or Firm*—Henry Croskell; William H. Duffey; Stanley M. Tarter

[57] ABSTRACT

A pressure-sensitive mark-recording system comprising (a) sheet material, (b) mark-forming components supported by the sheet material and arranged in juxtaposition comprising a chromogen material and an acid clay sensitizing agent for the chromogenic material which produces a color from the chromogenic material when brought into contact with the chromogenic material in the presence of a solvent for the chromogenic material with the solvent supported by the sheet material but separated from its sensitizing agent by a physical barrier which is rupturable on the application of the marking instrument to the sheet material, the invention characterized in that the liquid solvent is a solvent comprised of a blend of aromatic hydrocarbon components in which at least one-half the carbon atoms are benzenoid or a mixture of such hydrocarbons, and a diester component.

11 Claims, No Drawings

SOLVENTS USEFUL IN PRESSURE-SENSITIVE MARK-RECORDING SYSTEMS

This invention relates to solvents and solutions which are useful in the production of pressure-sensitive mark-recording systems and to such systems themselves.

The most familiar form of pressure-sensitive mark-recording system is the so-called carbonless copying paper which comprises a two-sheet system in which the under surface of the top sheet has a coating of microcapsules of a solution of a colourless chromogen, while the upper surface of the lower (receiver) sheet has an absorbent coating including a sensitizing agent for the chromogen. When a marking instrument is applied to the top sheet, the microcapsules are locally ruptured, thereby releasing the chromogen solution from the affected microcapsules to react with the underlying sensitizing agent and form coloured marks on the receiver sheet corresponding to the marks applied to the top sheet.

A successful carbonless copying paper system needs to meet a number of criteria. For example the marks on the receiver sheet should develop rapidly to a legible intensity of colour and a legible mark should persist for as long as the sheet is required to be kept. Whether the various criteria are met depends on a number of factors including the nature of the solvent, the sensitizing agent and the chromogen, and many different materials of each category have been proposed. Solvents which have been proposed include hydrocarbons, for instance petroleum fractions or synthetic hydrocarbons, especially synthetic aromatic hydrocarbons, such as partially hydrogenated terphenyls, and esters, for instance alkyl phthalates.

The sensitizing agent is usually an acid clay, for example an attapulgite or bentonite clay, or an acidic organic polymer, for example a phenolic resin or a partially or wholly hydrolysed styrene-maleic anhydride or ethylene-maleic anhydride polymer.

The chromogens which are probably most frequently referred to in the art are the phthalide derivatives, especially crystal violet lactone. These chromogens are usually used in solution in a hydrocarbon type solvent. One reason for this choice of solvent is that although the phthalide colour-formers are soluble in esters, for example, it is found that esters and certain other solvents having similar polarity to the esters, show too great a tendency to compete with the chromogen in affinity for the sensitizing agent, so that in some cases, no colour development occurs. This is especially so with acid clay sensitizing agents.

Crystal violet lactone (CVL) is usually used in conjunction with another chromogen because the colour produced by CVL, although of good initial intensity, tends to fade on exposure to air and light. Various chromogens are known having a performance which complements that of CVL (hereinafter referred to as complementary chromogens) in that, although they produce colours of lower initial intensity than CVL colour, their colours are substantially more resistant to fading, and the colours in fact intensify under the conditions which result in the fading of CVL colour. Complementary chromogens which can be used in the present invention include benzoyl leuco methylene blue (BLMB), the carbazolyl aminophenyl methane or carbazolyl indolyl methane compounds of British Patent Specification No. 1,548,059, the bis- or tris(carbazolyl) methane compounds of British Specification No. 1,550,968 and the tris-phenylaminophenyl-methane compounds of German Offenlegungsschrift No. 2 824 693.

British Patent Specification No. 1,526,353 discloses a solvent for use in pressure-sensitive copying paper systems comprising a blend of an aromatic hydrocarbon component and an aliphatic diester component, the latter being the dimethyl or diethyl ester of succinic, glutaric or adipic acid or a mixture of two or more such esters, the ester component being present in an amount of 0.5 to 10 parts by weight per 100 parts by weight of the aromatic hydrocarbon component. British Patent Specification No. 1,526,353 shows that the presence of the ester in such solvents improves the rate of colour development of crystal violet lactone on a sensitizing agent of the phenolic resin type compared with the rate of colour development obtained using the aromatic hydrocarbon component alone. The said Specification, however, also shows that higher alkyl esters and amounts of the ester component in excess of 10 parts by weight per 100 parts by weight of the aromatic hydrocarbon component are not effective in this way.

We have now found that when using an acid clay sensitizing agent and when using crystal violet lactone (CVL) in conjunction with a complementary chromogen, such limitations do not apply, beneficial effects of a different kind being obtained with solvents containing relatively large amounts of an ester component.

A solvent of the invention is a liquid comprising a blend of an aromatic hydrocarbon component and an ester component, the weight ratio of the two components in the blend being from 85:15 to 10:90, the aromatic hydrocarbon component being a hydrocarbon in which at least half the carbon atoms are benzenoid or a mixture of such hydrocarbons, and the ester component being a diester of the formula $$ROOC(C_nH_{2n})COOR^1 \text{ or } R^2COO(C_nH_{2n})OOCR^3$$

wherein n is an integer, for example from 1 to 20, R is an aliphatic or cycloaliphatic hydrocarbon group, $R^1$ is an aliphatic or cycloaliphatic hydrocarbon group or a benzyl or alkylbenzyl group, and each of $R^2$ and $R^3$ is an aliphatic hydrocarbon group or a mixture of such diesters, and the solvent having a volatility and viscosity such that it is suitable as a solvent for the chromogen in a pressure-sensitive mark-recording system.

A solution of the invention is a solution of a mixture of CVL and a complementary chromogen in a solvent of the invention; and a pressure-sensitive mark-recording system of the invention comprises (a) sheet material, (b) mark-forming components supported by the sheet material and arranged in juxtaposition but in unreactive condition, the said components comprising a chromogenic material which is a mixture of CVL and a complementary chromogen and an acid clay sensitizing agent for the chromogenic material which produces a colour from the chromogenic material when brought into contact with the chromogenic material in the present of a liquid solvent of the invention and (c) the said solvent supported by the sheet material but separated from the sensitizing agent by a physical barrier which is rupturable on the application of a marking instrument to the sheet material.

The use of a solvent in accordance with the present invention generally gives marks having somewhat lower initial intensity than those obtained by the use of aromatic hydrocarbons alone but significantly more intensity than those obtained by the use of the esters alone. Moreover, when exposed to light, the marks develop a maximum intensity after 2–5 days, the maxima obtained with the blends being higher than those obtained with either of the individual components.

The aromatic hydrocarbon component in a solvent for use in the present invention can be a single compound, but is often a mixture of compounds. Examples include partially hydrogenated terphenyls, for example hexahydroterphenyls and dodecahydroterphenyls. As normally produced, materials of this type are mixtures containing, in various proportions, fully hydrogenated terphenyls, partially hydrogenated terphenyls, and terphenyl itself. The terphenyl which is partially hydrogenated in obtaining such mixtures is itself a mixture of isomers. Commercially available hydrogenated terphenyls include Santosol 340 and Santosol 300, which are terphenyls partially hydrogenated to different extents, the latter having a higher degree of residual aromaticity than the former. Other aromatic hydrocarbons include benzylated and alpha-methylbenzylated alkylbenzenes, e.g. mono- and dibenzyl ethylbenzene, mono- and dibenzyl meta- and/or para-xylene, and mono (alpha-methylbenzyl)toluene, alkylnaphthalenes, e.g. dipropylnaphthalene and mono-alpha or -beta(2-hexyl)-naphthalene, and alkylbiphenyls, e.g. mono- and di-isopropylbiphenyls.

In an ester of the formula $ROOC(C_nH_{2n})COOR^1$ each of R and $R^1$ can, for example, be an alkyl or alkenyl group containing up to 18 carbon atoms, arranged in either a straight or branched chain. Examples of alkyl groups from which R and $R^1$ may be selected are isopropyl, n-butyl, isobutyl, n-hexyl, isohexyl, n-octyl, 2-ethylhexyl, decyl, dodecyl, tetradecyl and hexadecyl, while allyl and 4-methylpent-2-enyl are examples of alkenyl groups.

When R or $R^1$ is a cycloaliphatic hydrocarbon group, it is generally a cycloalkyl or alkyl-substituted cycloalkyl group containing from 5 to 10 carbon atoms, for example cyclopentyl, cyclohexyl or a methylcyclohexyl group, although the corresponding cycloalkenyl groups are also contemplated.

Alkylbenzyl groups from which $R^1$ may be selected are usually those wherein the alkyl substitution occurs in the benzene nucleus. Preferably the number of alkyl substituents does not exceed three, and each such substituent contains up to three carbon atoms; more preferably, the total number of carbon atoms in the alkyl substituent or substituents does not exceed four. Examples of alkylbenzyl groups are 2-, 3-, and 4-methylbenzyl, 4-ethylbenzyl, 4-isopropylbenzyl and 2,4-dimethylbenzyl.

When both R and $R^1$ are alkyl or alkenyl groups each preferably contains from 4 to 16, more preferably from 6 to 12 carbon atoms. When $R^1$ is a benzyl or alkylbenzyl group, R is preferably an alkyl or alkenyl group containing from 8 to 16 carbon atoms.

The grouping $C_nH_{2n}$ in esters of the formula $ROOC(C_nH_{2n})COOR^1$ is preferably a straight chain grouping, but it may be branched. Preferred esters of the formula $ROOC(C_nH_{2n})COOR^1$ are those wherein n has a value of from 2 to 8, i.e. (where $C_nH_{2n}$ is a straight chain grouping) the succinates, glutarates, adipates, pimelates, suberates, azelates and sebacates. Particularly good results have been obtained using mixtures of esters known as "nylonates", which are obtained by the esterification of mixtures of succinic, glutaric and adipic acids, especially with alkanols or mixtures of alkanols having from 6 to 12 carbon atoms, for example with a mixture of $C_7$ to $C_9$ alkanols or with a mixture of $C_8$ to $C_{10}$ alkanols.

Examples of individual diesters of the formula $ROOC(C_nH_{2n})COOR^1$ are di(2-ethylhexyl) succinate, n-butyl 2-ethylhexyl glutarate, allyl 2-ethylhexyl glutarate, di-isodecyl glutarate, di-isobutyl adipate, diallyl adipate, dicyclohexyl adipate, diisooctyl adipate, di(2-ethylhexyl)adipate, benzyl isobutyl succinate, benzyl isobutyl glutarate, benzyl isodecyl glutarate, allyl benzyl adipate, benzyl cyclopentyl adipate, diisobutyl pimelate, di-isopropyl suberate, diethyl azelate and di-sec-butyl sebacate.

In esters of the formula $R^2COO(C_nH_{2n})OOCR^3$, each of $R^2$ and $R^3$ can be, for example, an alkyl or alkenyl group of up to 18 carbon atoms arranged in either a straight or branched chain. Preferred groups are alkyl groups of from 1 to 9 carbon atoms, for example methyl, ethyl, isopropyl, isobutyl, sec-butyl, n-pentyl, isopentyl, hept-3-yl and n-nonyl. In preferred esters, n has a value from 2 to 10, and the grouping $C_nH_{2n}$ may be straight or branched. Branched groupings are preferred when n has a value of 4 or more such that not more than 4 carbon atoms separate the two oxygen atoms linked to the grouping $C_nH_{2n}$, as for example in esters of 2,2,4-trimethylpentane-1,3-diol.

Examples of individual diesters which can be used are ethylene glycol dipropionate, ethylene glycol diisobutyrate, propylene-1,2-glycol di-sec-pentoate, butylene-1,4-glycol diproponate, butylene-1,4-glycol dimethacrylate, hexamethylene glycol diacetate, 2,2,4-trimethylpentane-1,3-diol, 1-acetate, 3-isobutyrate, 2,2,4-trimethylpentane-1,3-diol diisobutyrate, 2,2,4-trimethylpentane-1,3-diol, 1-isobutyrate,3-sec-hexoate, and 2,2,4-trimethylpentane-1,3-diol, 1-isobutyrate, 3-n-octoate.

In solvents of the invention which are blends of an aromatic hydrocarbon and an ester or a mixture of esters of the formula $ROOC(C_nH_{2n})COOR^1$, the hydrocarbon component and the ester component are preferably present in proportions by weight from 60:40 to 15:85, and even more preferred are blends in which the proportions are from 50:50 to 20:80, for example a blend of from 25 to 35 parts by weight of the aromatic hydrocarbon component with from 75 to 65 parts by weight of the ester component.

Where the ester component is an ester or a mixture of esters of the formula $R^2COO(C_nH_{2n})OOCR^3$, the aromatic hydrocarbon component and the ester component are preferably present in proportions from 80:20 to 20:80, for example from 75:25 to 50:50.

The liquid solvent used in the present invention may consist of the blend of the components as defined above, provided its physical properties, e.g. viscosity, are suitable, or it may be a mixture of the blend with one or more other miscible liquids. Such other liquids include inert diluents, for example mineral and vegetable oils, such as kerosene, paraffin oil, castor oil, soybean oil, and corn oil. Also useful as diluents are (long-chain alkylated) benzenes, for example ($C_7$-$C_{16}$ alkyl) benzenes. A diluent functions to alter such physical properties of the solvent, for instance viscosity or vapour pressure, as may be desired for optimum handling or processing. A solvent of the invention preferably contains at least 50% by weight of the blend, but in some instances, the blend may be diluted with up to, for example, 3 times its own weight of diluent. For rapid development of print intensity, the solvent is preferably one having a viscosity in the range 5 to 15 centistokes at 38° C. Blends of the invention can usually be formulated without the use of diluents to give solvents having satisfactory viscosity characteristics, even at relatively low temperatures. This is an advantage of the blends over the aromatic hydrocarbons which are in many instances highly viscous below 0° C.

In the solutions of the invention, the proportions by weight of CVL and the complementary chromogen in the mixture can, for example, range from 10:90 to 90:10. Preferred proportions by weight are, however, from 25:75 to 75:25, more especially from 40:60 to 60:40. The concentration of the mixture in the solution may be as low as 0.1% by weight, but will usually be at least 0.5% by weight. The optimum concentration will vary with the particular solvent and the sensitizing agent, but is usually not in excess of 5% by weight, and is often in the range 2% to 4% by weight. Higher concentrations of the mixture, for example up to 10% by weight can be used, however, an advantage of the present solvents being that they have greater solvent power for mixtures of CVL and the complementary chromogen than have the aromatic hydrocarbon components alone.

The acid clay used as sensitizing agent for the chromogenic material in the present invention can be any of those conventionally used for this purpose, including bentonite and attapulgite. The naturally occurring clay may be subjected to various treatments such as acid extraction or calcination before use as the sensitizing agent.

Several encapsulation systems have been proposed for the encapsulation of the chromogen solution for use in carbonless copying paper, and the capsule walls in such systems generally may be formed from either natural or synthetic polymeric material. In the present invention, the capsule wall or shell is preferably made from a synthetic polymer, for example a polyurethane resin, a urea-formaldehyde resin, a melamine-formaldehyde resin or a polyamide resin. The use of such resins as shell-forming material in encapsulation is described in, for example, U.S. Pat. No. 3,016,308, British Pat. No. 989,264 and U.S. Pat. No. 3,429,827. Shells of this kind can be made significantly less permeable to the esters used in the present invention than shells made of natural polymeric material such as gelatin.

The mark-recording system of the present invention can be prepared according to well known conventional procedures. Descriptions of methods for preparing both the chromogen carrying paper and clay-coated receiving paper are to be found in the literature.

Although a preferred embodiment of this invention comprises a two-sheet system wherein the acid clay is carried by one sheet and a marking fluid comprising the chromogenic material and solvent is carried by a second sheet, the invention is not limited to such systems alone. The only essential requirement is that the chromogenic material and the acid clay be maintained in a separate or unreactive condition until pressure is applied to the system, and that upon the application of pressure the chromogenic material and acid clay are brought into reactive contact. Thus it is possible to have the chromogenic material and acid clay present in a dry and unreactive state on a common carrier and to have the solvent alone carried on a separate sheet, whereupon the application of pressure would release the solvent into the chromogenacidic material mixture and promote localized reaction and colour development. Obviously, many other arrangements, configurations and relationships of the solvent and the mark forming materials with respect to their encapsulation and location on the supporting sheet or webs can be envisaged, and such arrangements are within the scope of the present invention. For example, it is possible to coat a single paper or support member with all the components of this system to form a single self-contained unit which can be marked by the movement of a stylus or other pressure-imparting means upon the surface of the paper. Such papers are particularly useful for use in inkless recording instruments.

Solutions of the invention were evaluated by the following techniques:

A solution of a mixture of CVL and the complementary chromogen in the solvent was prepared. To estimate print intensity, a plate engraved with a pattern of dots was coated with sufficient of the solution to give a coating 18 microns in thickness, using a doctor blade. A carriage-supported roller having a paper sheet coated with an acid clay sensitizing agent wrapped around the roller was then moved slowly across the solution-coated plate under constant pressure. Colour developed on the paper. The paper was removed from the roller, the intensity of colour was measured, using equipment described below, at 20 different points on the paper surface and the values were averaged. After the initial reading, the paper was exposed to UV light using conventional laboratory equipment having four 15 watt U.V. sources, principal wave-lengths 254 and 366 mm, used to study colour fading under U.V. irradiation. It was removed at intervals for further colour intensity measurements, average values being obtained as before.

The results given in Tables 1, 2 and 3 below were obtained with a Macbeth RD 514 reflectometer calibrated against a "perfect white" of 0.07 units of optical density and a "perfect black" of 1.78 units of optical density, using standard "perfect white" and "perfect black" plates supplied by the manufacturer. With this reflectometer, the higher the reading, the greater the intensity. The results given in Tables 4 and 5 were obtained using a Neotex Tru-Color II Colorimeter to obtain the Y coordinate (brightness) value of the CIE colour, so that the numerical values presented are inversely related to colour intensity.

The following abbreviations are used:

AGS. A mixture of adipate, glutarate and succinate esters.

PHT. Partially hydrogenated terphenyl obtained by hydrogenating terphenyl using about 40% of the amount of hydrogen required for complete hydrogenation.

BMX. Benzylated meta-xylene.

TXIB. 2,2,4-Trimethylpentanediol 1,3-diisobutyrate.

For the results shown in Tables 1–4, the solution was a 3% by weight solution of a mixture of equal parts by weight of CVL and BLMB. The results of Table 5 were obtained using a 2% by weight solution of a mixture of equal parts by weight of CVL and a carbazolyl methane chromogen of the class described in British Patent Specification No. 1,550,968.

TABLE 1

| | Time (hrs) | | | | | |
|---|---|---|---|---|---|---|
| | 0 | 24 | 96 | 144 | 290 | 424 |
| Solvent | INTENSITY READINGS | | | | | |
| 100% Di($C_8$–$C_{10}$)** AGS | 0.37 | 0.72 | 0.75 | 0.71 | 0.68 | 0.64 |
| 7:3* Di($C_8$–$C_{10}$) AGS/PHT | 0.53 | 0.52 | 0.75 | 0.80 | 0.75 | 0.70 |
| 4:6* Di($C_8$–$C_{10}$) | | | | | | |

TABLE 1-continued

| Solvent | Time (hrs) 0 | 24 | 96 | 144 | 290 | 424 |
|---|---|---|---|---|---|---|
| | INTENSITY READINGS | | | | | |
| AGS/PHT | 0.52 | 0.80 | 0.72 | 0.67 | 0.58 | 0.55 |
| PHT | 0.57 | 0.65 | 0.52 | 0.50 | 0.47 | 0.44 |

**A mixture of $C_8$, $C_9$ and $C_{10}$ alkyl groups
*Weight ratios

These results show that the AGS/PHT blends gave over 90% of the initial intensity of 100 PHT, whereas the initial intensity given by the ester component alone was only 65% of that of 100% PHT. Colour development during UV irradiation showed a maximum for the 4:6 AGS/PHT blend after 24 hours, and a maximum for the 7:3 AGS/PHT blend after 144 hours, both maxima being higher than the maxima shown by the Nylonate alone or PHT alone.

Table 2 gives the colour intensity values obtained using blends of dialkyl esters and PHT in the weight ratio 7:3 in comparison with PHT alone. The results are expressed on a scale on which the initial colour intensity using PHT alone as the solvent is set at 100.

TABLE 2

| Solvent | Time (hrs) 0 | 22 | 42 | 70 | 112 | 159 | 207 |
|---|---|---|---|---|---|---|---|
| | INTENSITY VALUES | | | | | | |
| Di(2-ethylhexyl) AGS/PHT | 76.8 | 147.3 | 150.6 | 166.0 | 159.3 | 156.2 | 144.0 |
| Di($C_7$-$C_9$ alkyl) AGS/PHT | 71.6 | 144.9 | 148.3 | 166.1 | 159.5 | 155.0 | 141.0 |
| PHT | 100 | 129.1 | 114.5 | 120.2 | 103.6 | 98.4 | 90.2 |

The results in Table 2 show a similar effect to that demonstrated in Table 1, with a lower initial intensity for the blends than for PHT alone, but with the blends showing a significantly higher maximum intensity. Moreover, this relatively higher intensity persists after the onset of fading.

Table 3 gives the results obtained using blends of benzyl alkyl esters with PHT in the weight ratio 7:3 in comparison with a blend of kerosene and PHT in the weight ratio 7:3 and PHT alone. The intensity values are given on a scale on which the initial intensity obtained with PHT alone is expressed as 100.

TABLE 3

| Solvent | Time (hrs) 0 | 20 | 86 | 110 |
|---|---|---|---|---|
| | INTENSITY VALUES | | | |
| Benzyl isobutyl succinate/PHT | 63.8 | 103.1 | 124.9 | 125.1 |
| Benzyl isodecyl glutarate/PHT | 94.6 | 126.7 | 130.2 | 130.5 |
| Kerosene/PHT | 110.8 | 118.3 | 106.8 | 105.2 |
| PHT | 100 | — | — | — |

Table 4 gives results obtained using blends of equal parts by weight of AGS and PHT, and of AGS and BMX in comparison with PHT alone.

TABLE 4

| Solvent | Time (hrs) 0 | 90 |
|---|---|---|
| | Lightness (Y) CIE Color space | |
| Di($C_8$-$C_{10}$alkyl)AGS/PHT | 41.6 | 10.8 |
| Di($C_8$-$C_{10}$alkyl)AGS/BMX | 38.2 | 10.4 |
| PHT | 33.7 | 11.8 |

Both the AGS/PHT and the AGS/BMX blends gave greater print intensity after 90 hours UV exposure than PHT alone.

TABLE 5

| Solvent | Time (hrs) 0 | 24 | 48 | 72 |
|---|---|---|---|---|
| | Lightness (Y) CIE color Space | | | |
| 7:3*PHT/Di($C_7$-$C_9$ alkyl)AGS | 22.4 | 18.4 | 17.5 | 17.9 |
| 7:3*PHT/TXIB | 25.3 | 11.5 | 10.8 | 11.6 |
| 7:3*PHT/Kerosene | 14.2 | 13.2 | 17.3 | 20.2 |

*Weight ratios

The PHT/TXIB mixture showed particularly good results, and both ester blends gave greater print intensity after 72 hours UV exposure than the PHT/kerosene blend.

We claim:

1. A solvent suitable for use in a pressure-sensitive mark-recording system, said solvent comprising a blend of an aromatic hydrocarbon component and a diester component, the former being a hydrocarbon in which at least half the carbon atoms are benzenoid or a mixture of such hydrocarbons, characterized in that the diester component is a diester of either of the formulas $$ROOC(C_nH_{2n})COOR^1 \text{ or } R^2COO(C_nH_{2n})OOCR^3$$

wherein n is an integer from 1 to 20, R is an aliphatic hydrocarbon group containing up to 18 carbon atoms or a cycloaliphatic hydrocarbon group containing from 5 to 10 carbon atoms and $R^1$ is an aliphatic hydrocarbon group containing up to 18 carbon atoms or a cycloaliphatic hydrocarbon group containing from 5 to 10 carbon atoms or a benzyl group or an alkylbenzyl group containing up to 3 carbon atoms substituted onto the benzene nucleus and each of $R^2$ and $R^3$ is an aliphatic hydrocarbon group containing up to 18 carbon atoms or a mixture of such diesters, and the weight ratio of the aromatic hydrocarbon component to the diester component in the blend is from 85:15 to 10:90.

2. A solvent according to claim 1 in which the ester component is an ester or mixture of esters of the formula $$ROOC(C_nH_{2n})COOR^1$$

wherein n is an integer of from 1 to 10, each of R and $R^1$ is an alkyl or alkenyl group containing up to 18 carbon atoms, or a cyclopentyl, cyclohexyl or methylcyclohexyl group, or $R^1$ is alternatively a benzyl group or a nuclear alkyl-substituted benzyl group containing up to three alkyl groups each of which contains up to three carbon atoms.

3. A solvent according to claim 2 in which n in the formula of the diester has a value of from 2 to 8.

4. A solvent according to either of claims 2 and 3 in which the ester component is a succinate, glutarate or adipate or a mixture of succinate, glutarate and adipate.

5. A solvent according to claim 2 wherein each of R and $R^1$ is an alkyl group containing from 4 to 16 carbon atoms.

6. A solvent according to claim 2 wherein R is an alkyl group containing from 8 to 16 carbon atoms and $R^1$ is a benzyl group.

7. A solvent according to claim 2 wherein the proportions by weight of the aromatic hydrocarbon component and the ester component in the blend are from 50:50 to 20:80.

8. A solvent according to claim 2 which contains at least 50% by weight of the blend.

9. A solvent according to claim 1 in which the ester component is an ester or a mixture of esters of the formula $$R^2COO(C_nH_{2n})OOCR^3$$

where each of $R^2$ and $R^3$ is an alkyl or alkenyl group of up to 18 carbon atoms and n has a value from 2 to 10.

10. A solvent according to claim 9 in which each of $R^2$ and $R^3$ is an alkyl group of from 1 to 9 carbon atoms.

11. A solvent according to claim 9 in which $(C_nH_{2n})$ is a 2,2,4-trimethylpent-1,3-ylene group.

* * * * *

UNITED STATES PATENT AND TRADEMARK OFFICE

CERTIFICATE OF CORRECTION

PATENT NO. : 4,335,013

DATED : June 15, 1982

INVENTOR(S) : Pierre J. Allart, et al

It is certified that error appears in the above-identified patent and that said Letters Patent are hereby corrected as shown below:

On Abstract Page (left hand side)

[73] Assignee: Monsanto Company, St. Louis, Mo.

Should be:

-- [73] Assignee: Monsanto Europe S.A., Brussels, Belgium

Signed and Sealed this

*Twenty-first* Day of *September 1982*

[SEAL]

*Attest:*

GERALD J. MOSSINGHOFF

*Attesting Officer*

*Commissioner of Patents and Trademarks*